US006215851B1

(12) United States Patent
Meilunas et al.

(10) Patent No.: US 6,215,851 B1
(45) Date of Patent: Apr. 10, 2001

(54) HIGH CURRENT PROTON BEAM TARGET

(75) Inventors: Raymond John Meilunas, Hampton Bays; Stephan Taras Melnychuk, East Northport; Frederick F. Zimmerman, Jr., Bayshore, all of NY (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 09/120,941

(22) Filed: Jul. 22, 1998

(51) Int. Cl.[7] ..... G21G 4/00

(52) U.S. Cl. ..... 378/119; 378/120; 378/143; 376/157

(58) Field of Search ..... 378/119, 120, 378/143; 250/398, 489, 492.21, 492.1, 505.1; 313/363.1

(56) References Cited

U.S. PATENT DOCUMENTS

| | | | | |
|---|---|---|---|---|
| 3,426,420 | | 2/1969 | Grant et al. | 29/474.5 |
| 3,609,432 | | 9/1971 | Shimula | 313/59 |
| 3,793,108 | * | 2/1974 | Goldsworthy | 156/180 |
| 4,163,901 | | 8/1979 | Azam et al. | 250/401 |
| 4,323,780 | | 4/1982 | Tombaugh et al. | 250/419 |
| 4,431,709 | | 2/1984 | Bronnes et al. | 428/649 |
| 4,618,972 | | 10/1986 | Georgiou et al. | 378/34 |
| 4,637,042 | | 1/1987 | Braun | 378/143 |
| 4,674,109 | | 6/1987 | Ono | 378/130 |
| 4,705,376 | | 11/1987 | Schaub et al. | 354/298 |
| 4,768,212 | | 8/1988 | Appelt et al. | 378/141 |
| 4,864,141 | | 9/1989 | Gomberg | 250/390.04 |
| 4,945,562 | | 7/1990 | Staub | 378/130 |
| 5,040,200 | | 8/1991 | Ettinger et al. | 378/88 |
| 5,068,883 | | 11/1991 | Dehaan et al. | 378/86 |
| 5,098,640 | | 3/1992 | Gozani et al. | 376/166 |
| 5,115,459 | | 5/1992 | Bertozzi | 378/88 |
| 5,159,617 | | 10/1992 | King et al. | 378/57 |
| 5,199,054 | | 3/1993 | Adams et al. | 378/21 |
| 5,222,116 | * | 6/1993 | Eloff | 378/143 |
| 5,227,800 | | 7/1993 | Huguenin et al. | 342/179 |
| 5,251,240 | | 10/1993 | Grodzins | 376/157 |
| 5,278,418 | | 1/1994 | Broadhurst | 250/390.04 |
| 5,282,235 | | 1/1994 | Schmor et al. | 378/53 |
| 5,338,934 | | 8/1994 | Morohashi et al. | 250/336.2 |
| 5,825,848 | * | 10/1998 | Vishup | 378/144 |

* cited by examiner

*Primary Examiner*—Teresa M. Arroyo
*Assistant Examiner*—Gioacchino Inzirillo
(74) *Attorney, Agent, or Firm*—Scully, Scott, Murphy & Presser

(57) ABSTRACT

In accordance with the present invention, there is provided a proton beam target for generating gamma rays which are generated therefrom in response to an impinging proton beam. The proton beam target is provided with a $^{13}C$ gamma reaction layer for generating the gamma rays therefrom. The proton beam target is further provided with a stopping layer for mitigating transmission of the proton beam therethrough. The stopping layer is formed of a refractory metal which is hydrogen soluble for dissolving implanted hydrogen molecules therewithin as a result of the impingement of the proton beam and which is chemically reactive with the $^{13}C$ gamma reaction layer for chemically bonding therewith.

19 Claims, 1 Drawing Sheet

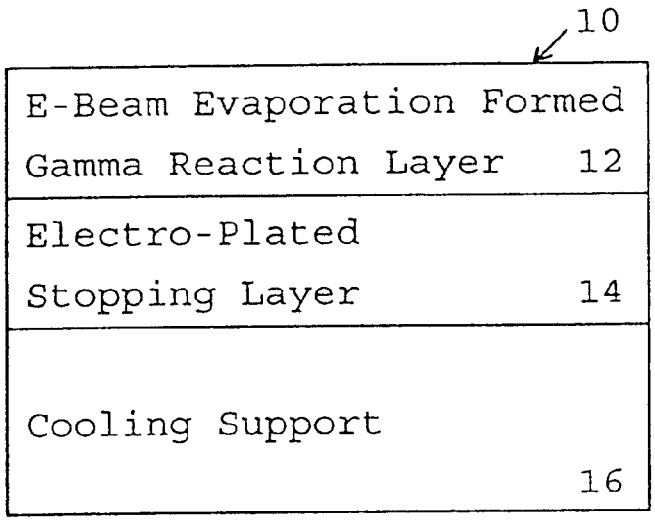
Fig. 1 - Prior Art
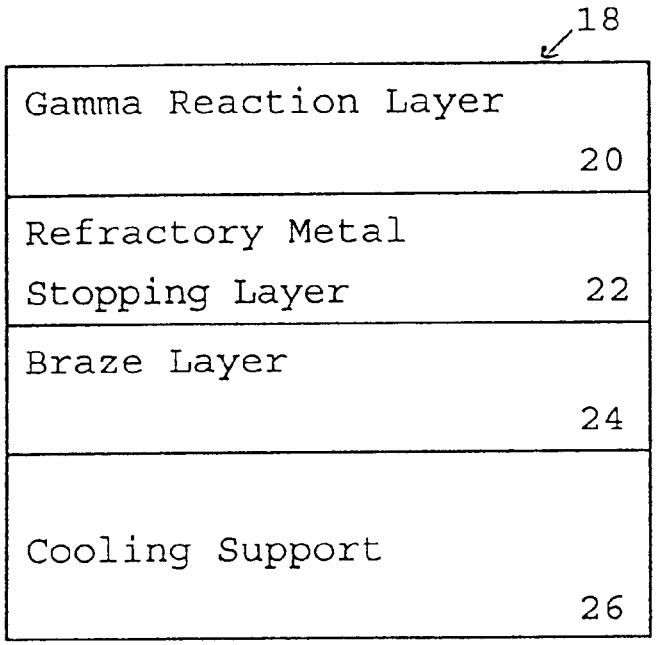
Fig. 2

HIGH CURRENT PROTON BEAM TARGET

FIELD OF THE INVENTION

The present invention relates generally to gamma ray based nitrogen detection systems, and more particularly to a high current proton beam target which generates gamma emissions and utilizes a stopping layer formed of a refractory metal.

BACKGROUND OF THE INVENTION

The need to detect contraband, such as drugs and explosives, is well appreciated. Efforts to detect contraband from being smuggled through various ports of entry, such as airports, border crossings and boat docks, has been a focus of attention. Various non-intrusive scanning techniques have been developed in the art which are more accurate than contemporary X-ray scanning techniques. It is known that nitrogen is a common element found in many illicit drugs and explosives. As such, nitrogen detection systems have been developed to detect nitrogen containing contraband.

A type of nitrogen detection system utilizes gamma rays. Generally, such a system uses a beam of energetic protons which are focused upon a target. The incident proton beam excites the target material according to well known principles, thereby causing it to produce gamma rays.

In this regard, it is known that when about 1.75 MeV protons impinge on a suitable target, e.g., a material coated with $^{13}C$, they have a high probability of producing 9.17 MeV gamma rays by the reaction $^{13}C(p, y)^{14}N$. These gamma rays are emitted from the target nonuniformly at all angles. Those gamma rays emitted at about 80.66°, with respect to the direction of the proton beam, have a large probability of being resonantly absorbed by $^{14}N$ contained in an object of interest. Detection of such absorption phenomenon is used to analyze the amount of nitrogen in an object of interest in order to detect nitrogen containing contraband.

As depicted in FIG. 1, a typical configuration of a prior art proton beam target consists of a thin film of $^{13}C$ which is used to produce gamma rays. This gamma reaction layer is formed onto a proton stopping layer via an electron beam (or e-beam) evaporation process. The stopping layer is used to prevent undesirable transmission of energetic protons after they have traversed through the $^{13}C$ gamma reaction layer. Because the incident proton beam results in the generation of substantial heat energy within the target, the stopping layer is attached to a cooling support for transferring heat energy away from the gamma reaction and stopping layers. The cooling support is typically formed of Copper or Copper alloys or Beryllium.

The stopping layer is formed of a suitable high atomic number (z) material. The high z material is required to effectively prevent the transmission of energetic protons. In this regard, the high z stopping layer is required to be of a minimal thickness necessary to fully stop the proton beam. The stopping layer, however, is also desired to be less than a thickness which substantially attenuates the gamma signal generated by the $^{13}C$ gamma reaction layer. The stopping layer must additionally be formed of a material which will not react with the high energy proton beam to produce additional gamma signals which will interfere with the desired $^{13}C$ resonant gamma emission. In addition, the stopping layer must survive the operating temperatures of the target. Thus, for example, the prior art has been to use a stopping layer formed of gold (Au) which is electro-plated onto a cooling support to a thickness of roughly 20 microns.

The desire to decrease the inspection or scanning time has driven the need to increase the operating current of the proton beam. Previously, due to the limited proton beam operating currents, prior art configurations have typically utilized proton beams operating at currents on the order of 10 micro-amperes. Proton beams have now been developed which are capable of operating at currents of 10 milliamperes (mA), three orders of magnitude greater than prior art devices. Prolonged exposure of the above described prior art targets to such high current protons, however, results in blistering and delamination of the prior art gold stopping layer contained therein, as well as, blistering and delamination of the outer $^{13}C$ layer. Blistering describes the phenomenon wherein the incident beam of protons result in implantation of hydrogen atoms into the gold stopping layer. The implanted hydrogen tends to coalesce to form bubbles and causes the stopping layer to blister and delaminate the $^{13}C$ coating/stopping layer interface from the stopping layer/cooling layer interface. As a result, the generated gamma rays are of an undesirable quality and nature and of a greatly reduced quantity. Thus, while prior art targets have been effective while used with proton beam currents of 10 micro amperes, such targets are inadequate when used with relatively high current proton beams.

It is therefore evident that there exists a need in the art for a proton beam target which is able to withstand exposure to the bombardment of high current protons while producing the desired gamma emissions.

SUMMARY OF THE INVENTION

In accordance with the present invention, there is provided a proton beam target for generating gamma rays which are generated therefrom in response to an impinging proton beam. The proton beam target is provided with a $^{13}C$ gamma reaction layer for generating the gamma rays therefrom. The proton beam target is further provided with a stopping layer for mitigating transmission of the proton beam therethrough and thus mitigating the production of undesirable gamma rays. The stopping layer is formed of a refractory metal which has a relatively high hydrogen solubility for dissolving implanted hydrogen atoms therewithin as a result of the impingement of the proton bean and which is also chemically reactive with the $^{13}C$ gamma reaction layer for improved chemically bonding therewith.

Preferably, the refractory metal is chosen from the group consisting of Tantalum, Zirconium, Niobium and Hafnium. As such, the stopping layer has a hydrogen solubility greater than that of gold. In addition, the $^{13}C$ gamma reaction layer is sputter deposited onto the stopping layer. In this regard, sputter deposition ensure that a carbide phase is formed between the $^{13}C$ gamma reaction layer and the stopping layer as a result of sputter ion assisted chemical reactions thereat.

The proton beam target is preferably provided with a cooling support for dissipating heat energy away from the stopping layer. The stopping layer is attached to the cooling support and the stopping layer through a brazing process and a braze layer is formed therebetween. The braze layer is formed of a Silver based braze alloy.

As such, based on the foregoing, the present invention mitigates the inefficiencies and limitations associated with prior art proton beam targets. The present invention is particularly adapted to facilitate impingement of relatively high current proton beams. When exposed to relatively high current protons, prior art targets suffer from blistering due to hydrogen bubble formation. Advantageously, the stopping layer is formed of a refractory metal which has a relatively high hydrogen solubility. In this regard, the target of the present invention mitigates against blistering due to the formation of hydrogen bubbles formed within the stopping layer. This is in comparison to prior art stopping layers which are typically formed of electro-plated gold which has no solubility with regard to hydrogen. In addition, the bond between the gamma reaction layer and the stopping layer is contemplated to be stronger than prior art designs. This is especially the case where gold is used in prior art designs and the target is subjected to relatively high operating temperatures. In particular, because the stopping layer is formed of a refractory metal, it is inherently heat resistant and also capable of reacting with the gamma reaction layer for forming a stable carbide phase therebetween. Such a carbide phase is contemplated to facilitate strong bonding thereat. Furthermore, the gamma reaction layer is preferably sputter deposited which provides a relatively stronger bond with the stopping layer than electron beam evaporation techniques used in the prior art. Further, the sputter depositing process is contemplated to facilitate selective attachment of the gamma reaction layer and thus mitigates against unnecessary material loss in comparison to electron beam techniques.

Furthermore, the stopping layer is brazed to a cooling support. Such brazing forms an intermediate braze layer therebetween which facilitates a strong bond thereat and facilitates residual stress relief with respect to the stopping layer. Accordingly, the present invention represents a significant advance in the art.

BRIEF DESCRIPTION OF THE DRAWINGS

These, as well as other features of the present invention, will become more apparent upon reference to the drawings wherein:

FIG. 1 symbolically illustrates a cross-sectional view of a prior art proton beam target; and FIG. 2 symbolically illustrates a cross-sectional view of the proton beam target of the present invention.

DETAILED DESCRIPTION OF THE PREFERRED EMBODIMENT

Referring now to the drawings wherein the showings are for purposes of illustrating a preferred embodiment of the present invention only, and not for purposes of limiting the same, FIG. 2 illustrates a proton beam target 18 which is constructed in accordance with the present invention for generating gamma rays used in nitrogen containing contraband detection systems.

In accordance with the present invention, there is provided a proton beam target 18 for producing gamma rays when impinged upon with a proton beam. The proton beam target 18 is provided with a gamma production layer 20 which is formed of $^{13}C$ for producing gamma rays. The gamma production layer 20 generates resonant gamma rays at an energy of 9.17 MeV when subjected to the impingement of a proton beam having an energy of 1.75 MeV by the reaction $^{13}C(p, y)^{14}N$.

The gamma production layer 20 is attached to a high z stopping layer 22. As one of ordinary skill in the art will appreciate, the high z stopping layer 22 is formed to be of a minimal thickness necessary to mitigate the transmission of energetic protons therethrough. Furthermore, the high z stopping layer 22 is also formed to be less than a thickness which substantially attenuates the gamma signal generated by the $^{13}C$ gamma reaction layer 20.

The high z stopping layer 22 is formed of a refractory metal. In the preferred embodiment of the present invention, the stopping layer 22 is formed of Tantalum (Ta) which has an atomic number of 73. Furthermore, the Tantalum stopping layer 22 is preferably 20 to 130 microns thick and takes the form of a thin foil. Other refractory metals which may be used to form the stopping layer 22 include, for example, Zirconium (Zr, atomic number 40), Niobium (Nb, atomic number 41) and Hafnium (Hf, atomic number 72). It is contemplated that a refractory metal is a metal or alloy that is relatively heat-resistant and, therefore, having a relatively high melting point. Importantly, it is further contemplated that the refractory metal has a relatively high hydrogen solubility, i.e., capable of dissolving hydrogen atoms.

Because the stopping layer 22 is formed of a refractory metal, the stopping layer 22 is characterized by being formed of relatively high atomic number or high z material which facilitates the mitigation of energetic protons being transmitted therethrough. Furthermore, the refractory metal stopping layer 22 is substantially non-reactive with high energy protons with respect to any undesirable production of gamma signals which would interfere with the desired resonant gamma emissions from the gamma reaction layer 20.

As mentioned above, in operation, a substantial amount of heat energy is generated within the target 18 as a result of the impingement of the energized protons. In this regard, the refractory metal formed stopping layer 22 is particularly adapted to withstand high operating temperatures when subjected to relatively high current protons.

As further mentioned above, blistering may result in the prior art stopping layer 14 of a typical prior art target 10 when subjected to high current proton beams (See, FIG. 1). This is due to hydrogen molecules being implanted therein. Referring back to FIG. 2, the stopping layer 22 of the target 18 of the present invention, however, is formed of a refractory metal which has a relatively high hydrogen solubility. In this regard, the stopping layer 22 mitigates against the formation of hydrogen bubbles therein, and therefore mitigates against blistering. As such, is stopping layer 14 is contemplated to be formed of a material which is has a hydrogen solubility greater than that of gold which has typically been used for prior art stopping layers.

In the preferred embodiment of the present invention, the $^{13}C$ gamma reaction layer 20 is sputter deposited onto the high z stopping layer 22. Such sputtering deposition is effectuated according to those procedures which are well known to one of ordinary skill in the art. Sputter deposition, is contemplated to facilitate selective placement of the $^{13}C$ material onto the stopping layer 22 to enhance the bonding of the $^{13}C$ to the refractory metal. In addition to sputter deposition, other fabrication methods may be used and are chosen from those well known to one of ordinary skill in the art. Advantageously, because the high z stopping layer 22 is formed of a refractory metal, such as Tantalum, the $^{13}C$ gamma production layer 20 is particularly suited to chemically bond therewith. In particular, a carbide phase may be produced at the interface between the high z stopping layer 22 and the $^{13}C$ gamma production layer 20 as a result of chemical reactions thereat.

The stopping layer 22 is attached to a cooling support 26. The cooling support 26 is used to transfer and dissipate heat energy away from the gamma production and stopping layers 20, 22. In addition, the cooling support 26 provides structural support for the relatively thin gamma reaction and stopping layers 20, 22. Preferably, the cooling support 26 is formed of material having a relatively high thermal conductivity such are Cooper (Cu), Beryllium (Be) and alloys formed thereof. It is contemplated that other suitable materials may be used which are chosen from those well known to one of ordinary skill in the art.

In the preferred embodiment of the present invention, the stopping layer 22 is attached to the cooling support 26 through a brazing process. Brazing is a joining process which is effectuated at temperatures above 500° C. As such, a braze layer 24 is interposed between the stopping layer 22 and the cooling support 26. The material used to form the braze layer 24 is one which wets both the interfaces with the stopping layer 22 and the cooling support 26. It is contemplated that a wetability characteristic encourages adhesion between the interfacing materials. For example, where the stopping layer 22 is formed of Tantalum, Silver based braze alloy is preferably used to form the braze layer 24.

The target 18 of the present invention may be exposed to operating temperatures of approximately 400° C., especially where a 1.75 MeV proton beam is operated at about 10 mA. It is contemplated that attachment via brazing provides an effective bond between the stopping layer 22 and the cooling support 26 within such operating temperatures. Such effective bonding is due to alloying effects at the interfaces between the stopping layer 22, the braze layer 24 and the cooling support 26. The melting point of the material used to form the braze layer 24 is considered with respect to the target operating temperatures. Importantly, as a result of the relatively high temperatures resulting from proton bombardment, thermal stresses may develop within the stopping layer 22 with respect to the cooling support 26. This is due to differences of the coefficients of thermal expansion between the stopping layer 22 and the cooling support 26. The braze layer 24, however, provides a medium in which any built-up thermal stress contained within the stopping layer 26 may be gradually released across the braze layer 24. For example, where Tantalum is used to form the stopping layer 22 and Cooper or Beryllium is used to form the cooling support 26, Silver based alloy is preferably used to form the braze layer 24.

Additional modifications and improvements of the present invention may also be apparent to those of ordinary skill in the art. Thus, the particular combination of parts described and illustrated herein is intended to represent only one embodiment of the present invention, and is not intended to serve as limitations of alternative devices within the spirit and scope of the invention.

What is claimed is:

1. A proton beam target for generating gamma rays which are generated therefrom in response to an impinging proton beam, the proton beam target comprising:

a $^{13}C$ gamma reaction layer for generating the gamma rays therefrom; and a stopping layer for mitigating transmission of the proton beam therethrough, the stopping layer being formed of a refractory metal which has a relatively high hydrogen solubility for dissolving implanted hydrogen atoms therewithin as a result of the impingement of the proton beam and which is chemically reactive with the $^{13}C$ gamma reaction layer for chemically bonding therewith.

2. The proton beam target of claim 1 wherein the refractory metal is chosen from the group consisting of Tantalum, Zirconium, Niobium and Hafnium.

3. The proton beam target of claim 1 wherein the stopping layer is formed of a metal foil.

4. The proton beam target of claim 1 wherein the stopping layer has a thickness of approximately between 20 to 130 microns.

5. The proton beam target of claim 1 wherein the stopping layer has a hydrogen solubility greater than that of gold.

6. The proton beam target of claim 1 wherein the stopping layer is chemically reactive with the $^{13}C$ gamma reaction layer to form carbide atoms therebetween.

7. The proton beam target of claim 1 wherein the $^{13}C$ gamma reaction layer is sputter deposited onto the stopping layer.

8. The proton beam target of claim 1 further comprises a cooling support for dissipating heat energy away from the stopping layer, wherein the stopping layer is attached to the cooling support and the stopping layer is interposed between the $^{13}C$ gamma reaction layer and the cooling support.

9. The proton beam target of claim 8 wherein the cooling support is formed of Copper.

10. The proton beam target of claim 8 wherein the cooling support is formed of Beryllium.

11. The proton beam target of claim 8 further comprises a braze layer which is interposed between stopping layer and the cooling support for attaching the stopping layer to the cooling support.

12. The proton beam target of claim 11 wherein the braze layer is formed of Silver based braze alloy.

13. A method of fabricating a proton beam target for generating gamma rays which are reflected therefrom in response to an impinging proton beam, the method comprising the steps of:

(a) forming a stopping layer of a refractory metal for mitigating transmission of the proton beam therethrough, the stopping layer having a relatively high hydrogen solubility for dissolving implanted hydrogen atoms therewithin as a result of the impingement of the proton bean and being chemically reactive with $^{13}C$; and (b) attaching a $^{13}C$ gamma reaction layer for generating gamma rays therefrom in response to the impinging proton beam.

14. The method of claim 13 wherein the $^{13}C$ gamma reaction layer is attached to the stopping layer via sputter deposition.

15. The method of claim 13 wherein step (a) further comprises chemically reacting the $^{13}C$ gamma reaction with the stopping layer to form a carbide phase therebetween.

16. The method of claim 13 further comprising the step of:

(c) attaching the stopping layer onto a cooling support for dissipating heat energy away from the stopping layer.

17. The method of claim 16 wherein the stopping layer is attached to the cooling support via brazing.

18. The method of claim 17 wherein the brazing is effectuated at a braze temperature greater than 500° C.

19. The method of claim 18 further comprising the steps of:

(d) cooling the stopping layer to a temperature less than the braze temperature; and (e) reliving any residual thermal stress developed within the stopping layer through the movement of the stopping layer relative to the cooling support.

* * * * *